United States Patent [19]

Dalland et al.

[11] Patent Number: 4,750,981

[45] Date of Patent: Jun. 14, 1988

[54] APPARATUS FOR ELECTROPLATING LIMITED SURFACES ON A WORKPIECE

[75] Inventors: Harold W. Dalland; Richard Herrmann, both of Seattle; Barry L. Kendall, Puyallup, all of Wash.

[73] Assignee: The Boeing Company, Seattle, Wash.

[21] Appl. No.: 913,231

[22] Filed: Sep. 30, 1986

[51] Int. Cl.[4] ..... C25D 17/00; C25D 17/12

[52] U.S. Cl. ..... 204/224 R; 204/272; 204/275

[58] Field of Search ..... 204/224 R, 272, 26, 204/275

[56] References Cited

U.S. PATENT DOCUMENTS

| | | | |
|---|---|---|---|
| Re. 29,874 | 1/1979 | Becker | 204/15 |
| 2,739,937 | 3/1956 | Forestek | 204/272 |
| 3,036,967 | 5/1962 | Lapham | 204/225 |
| 3,071,521 | 1/1963 | Ehrhart | 204/16 |
| 3,546,088 | 12/1970 | Barkman et al. | 204/224 R |
| 3,860,499 | 1/1975 | Graham et al. | 204/15 |
| 3,869,372 | 3/1975 | Becker | 204/224 R |
| 3,974,042 | 8/1976 | Angelini | 204/224 R X |
| 4,082,638 | 4/1978 | Jumer | 204/224 R |
| 4,125,447 | 11/1978 | Bachert | 204/26 X |
| 4,224,117 | 9/1980 | Edwards et al. | 204/15 |
| 4,447,306 | 5/1984 | Ushio et al. | 204/224 R |

FOREIGN PATENT DOCUMENTS

| | | | |
|---|---|---|---|
| 64440 | 10/1949 | Netherlands | 204/224 |
| 26504 | 11/1913 | United Kingdom | 204/224 R |

*Primary Examiner*—Donald R. Valentine

*Attorney, Agent, or Firm*—Seed and Berry

[57] ABSTRACT

Disclosed is a method and apparatus for plating selected portions of a workpiece that cannot suitably be plated in dip-tank processes. The invention is particularly suitable for plating apertures in large parts. The aperture is enclosed between two containers, one on each side of the aperture. The containers are held in sealing position on the workpiece by means of an elongated rod that passes through both containers and through the aperture. Fastening means threaded onto each end of the rod engage container surfaces to urge the containers into sealing engagement with the workpiece, completely enclosing the aperture to be plated. An anode connected to a power source is mounted upon the elongated rod, preferably positioned substantially within the aperture. Application of a current with the workpiece connected to a cathode results in plating of the aperture.

5 Claims, 2 Drawing Sheets

APPARATUS FOR ELECTROPLATING LIMITED SURFACES ON A WORKPIECE

DESCRIPTION

1. Technical Field

The invention relates to electroplating portions of a workpiece where ank plating and brush plating are not practical. More particularly, the invention relates to methods and apparatus suitable for plating a wide variety of surfaces on large parts.

2. Background of the Invention

Where it is desired to apply a metal coating to workpiece or part by means of an electroplating process, the workpiece is usually dipped into a tank containing a salt of the metal to be plated on the workpiece. An anode is inserted into the solution adjacent to the workpiece and an electrical current applied to the anode with the workpiece, acting as a cathode such that the desired metal plates out onto the workpiece. In many instances, it may not be possible or practical to employ the conventional dip-tank plating process. The workpiece may be too large or it may be desirable to plate only a limited area on the workpiece. Also, it may be necessary to plate a portion of a part, after it has been attached to a larger assembly that cannot be dipped or to which access is difficult.

Brush plating is an alternative to the dip-tank process that is useful for plating repairs in the field or production plating where parts are too large, or where it is otherwise not feasible to plate in a tank. In brush plating, an operator continuously rubs an anode over a given surface to deposit a desired plating. In many instances, it requires hours or days to deposit a desired coating. As a further limitation, brush coating is not suitable for applying certain desired chrome platings that, heretofore, have required dip-tank type solutions.

A number of plating apparatus are known that are designed to plated limited portions of selected workpieces. For example, Lapham, in U.S. Pat. No. 3,036,967, describes an apparatus for plating piston ring grooves without plating other piston external surfaces. Lapham provides a specialized electrode assembly that fits closely about the piston ring grooves. The assembly is dipped into a plating solution and plating occurs only adjacent the electrodes in the grooves.

Graham et al., in U.S. Pat. No. 3,960,499, shows apparatus for plating selected areas on a strip of material. The strip is indexed over an open container that includes an anode and is filled with a plating solution. A sealing bar advances into contact with the strip material, forming a seal between the container, strip and bar. The level of plating solution is raised until it contacts the area on the strip to be plated and a current is then applied to the anode.

Becker, in U.S. Pat. No. 3,689,372 and U.S. Pat. No. Re 29,874, describes an apparatus for plating the edges of a stack of metal sheets. In one embodiment, shown in FIGS. 5–11, the stack edge is advanced into a tank that includes movable walls that advance into sealing contact with the stack. The container is then flooded with the plating solution and proceeds in the conventional manner.

Ehrhart, in U.S. Pat. No. 3,071,521, describes a method and apparatus for plating an aperture on a printed circuit board. The circuit board is mounted upon a base plate that supports a pair of container halves that pivot into contact with opposite sides of the aperture. The closed container formed includes an electrode and is filled with an electroplating solution whereupon application of a current results in the aperture receiving the desired plating.

The prior art apparatus are substantially limited in usefulness to specific objects sought to be plated, such as strip material or small circuit boards. There remains a need in the technical field for an apparatus of general usefulness for plating limited surface areas on large parts.

DISCLOSURE OF THE INVENTION

It is an object of the invention to provide a means for plating relatively small areas on large parts that cannot satisfactorily be dip-tank or brush coated.

It is an object of the invention to provide apparatus that are capable of plating a wide variety of irregular surfaces or apertures that are features of larger workpieces or parts.

The apparatus of the invention for electroplating a limited surface area on a workpiece includes a container that has an open wall that is contoured to engage and seal to surfaces of the workpiece to surround and isolate the surface that is to be plated. The container is designed to hold a plating solution that submerges the surface to be plated. The apparatus includes an anode fixed to a container interior wall, but electrically isolated therefrom, positioned such that the electrode is adjacent the workpiece surface to be plated and submerged in the plating solution. The apparatus includes a means for urging the container into sealing contact with the surface of the workpiece, adjacent the surface to be plated. Applying a current to the anode with the workpiece electrically connected as a cathode causes the surface enclosed by the container and exposed to the plating solution to be plated.

The open wall of the container may be contoured to engage and plate a relatively small non-planar surface on a larger substantially planar workpiece. The open wall of the container may be a bottom wall that is urged into contact with the workpiece simply by means of the weight of the container.

A preferred apparatus of the invention is designed for electroplating an aperture in a workpiece. The apparatus of the invention includes a pair of containers, each including an open wall contoured to engage the workpiece, adjacent the aperture, on opposite sides of the workpiece, to surround and isolate the aperture. The apparatus includes an anode that is positioned within the aperture to be plated. The anode is mounted on a rod means that passes through each container. Fastening means engage each end of the rod to urge the two container halves into sealing contact with the workpiece. The assembled container is filled with a plating solution and an anode connected to a source of electrical energy with the workpiece as a cathode, such that application of electrical current causes the aperture to be plated. Preferably, the rod supporting the anode is an electrical conductor and the electrical connection to the anode may be achieved exterior to the container.

In another preferred embodiment of the apparatus of the inventon, plating may be applied to a portion of an elongated workpiece. The apparatus includes a pair of containers that, together, enclose a length of the workpiece, holding sufficient plating solution to submerge the workpiece. Each container includes an open wall that engages and seals to the other container wall. End wall openings are contoured to include an aperture that accommodates a portion of the cross-section of the workpiece such that the container pair urged together in sealing contact surrounds and contains an elongated length of the workpiece plating with the balance of the elongated workpiece extending from the end walls of the container pair. Fastening means pass through both the containers, spaced from the workpiece, to urge the two containers together into sealing contact with workpiece. An anode is fixed to, but electrically isolated from, interior wall of the container. The application of a current to the anode with the workpiece connected as cathode causes the length of workpiece enclosed within the container and exposed to the plating solution to be plated.

BEST MODE FOR CARRYING OUT THE INVENTION

Figure 1:
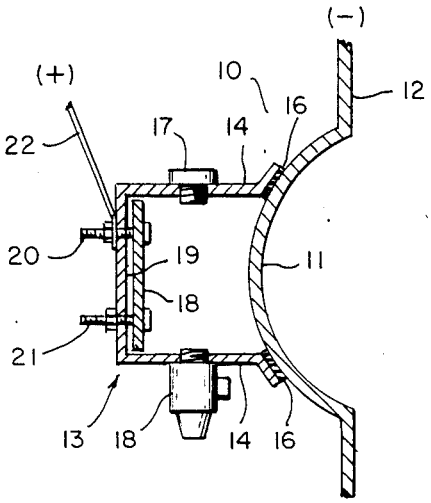
FIG. 1 is a schematic sectional view of an apparatus of the invention for plating a limited, curved portion of a substantially planar, large workpiece.

Referring to FIG. 1, an apparatus of the invention 10 for plating a curved portion 11 of a large substantially planar workpiece 12 is shown schematically. A container 13 of sufficient dimensions to enclose the area to be plated is provided with end walls 14 that are contoured to engage the surfaces of the workpiece adjacent to the plating area. The contoured end walls 14 include supporting flanges 15 that bear on the workpiece. Gaskets 16 or the like are provided about the periphery of the walls 14, providing sufficient contact to form a water-tight seal between the workpiece and the container. An inlet port 17 and a discharge port 18 allow filling and discharge of plating solution such that the area to be plated may be completely submerged in the plating solution.

An anode 18 typically of carbon or of the metal to be plated is fastened to an interior wall 19 of the container by a pair of fasteners 20, 21 that electrically isolate the anode from the container. One fastener 20 is electrically conductive with respect to the anode 18 such that a power line 22 connects the anode to a power source (not shown). The workpiece is connected to the same power source and functions as a cathode during the plating process.

A means for securing and urging the container into sealing contact with workpiece is provided (not shown). The means selected will vary with workpiece size and positioning. Strong backs, braces, C-clamps, and the like (not shown) are typically supported on or adjacent to the part as necessary. Where the workpiece is horizontally positioned, the weight of the container or a weight added thereto is generally sufficient to form the necessary water-tight seal between the workpiece and the container. Alternatively, the sealing gasket 16 may be temporarily joined to the workpiece surface by adhesive means.

Any conductive or nonconductive surface to which a conductive primer has been applied may be plated. The area to be plated may be limited by masking or limiting application of the conductive primer. For example, it is possible to copper/nickel plate composite structural materials using the apparatus of the invention. Such composites generally include a reinforcing fabric impregnated with a polymer resin and may be laminantes, of glass fibers, graphite/epoxy, or graphite/polyimides surfaces to which a conductive primer has been applied. The plating apparatus of the invention allows plating processes to be applied to large parts not readily adaptable to tank plating. Large composite parts requiring special electrical conductive areas i.e., apertures or cut-outs, antenna element patterns, ground planes or the like, may be plated with an appropriate conductor material. The plating process produces a void-free metal coating that may be made as smooth as desired. The apparatus of the invention is useful in assembling composite components that must be electrically interconnected to provide a spark-free structural composite assembly, such as a fuel tank or lightweight antenna assembly that must be connected for lightning strike protection and the like.

Plating solutions are well-known in the plating art and are substantially conventional for use with the apparatus of the invention. Thus, a principal plating solution of interest includes copper sulphate and sulfuric acid. The typical plating operation may be conducted between 70°-90° F. with a cathode current density of 20-60 amperes/sq. ft. The anode may be constructed of phospherized copper and the solution is vigorously air-agitated during the plating operation. A preferred anode/cathode area ratio is generally at least within the range of 1:1-2:1.

Figure 2:
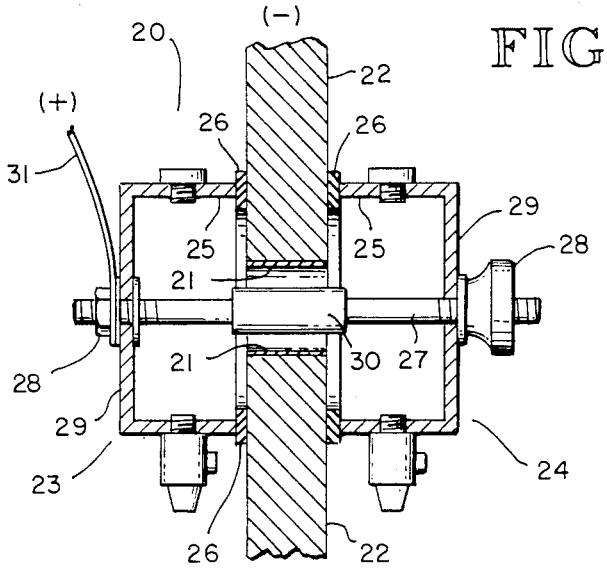
FIG. 2 is a schematic sectional view of an apparatus of the invention for plating an aperture in a workpiece.

Referring to FIG. 2, an apparatus of the invention 20 is shown for plating the interior surfaces of an aperture 21 or the like in a workpiece panel 22. The panel 22 may, for example, be a carbon fiber-epoxy composite or the like, including apertures and machined cut-outs that must be copper plated to provide electrical conductivity between system components to be mounted upon the panel (such as pumps, hydraulic bulkhead fittings, etc.) and the fiber ends within the cut edges of the walls. The copper deposit must be uniform and continuous with no local irregularities or voids. Flange areas around such cutouts are not normally conductive due to resin on the panel surface. These areas are made conductive by spray painting a conductive primer on surfaces and chamfer zones around the aperture.

The apparatus of the invention 20 includes a pair of containers 23, 24, each including end walls 25 that are contoured to engage panel surfaces adjacent to the aperture 21 to be plated. Gaskets 26 temporarily join the container end wall peripheral surfaces 25 to the workpiece panel 22, forming a water-tight seal.

An elongated rod 27 passes through each container and through the aperture 21 to be plated. The rod includes fasteners 28 that are fixed to the rod ends and adjustably bear on the exterior rear walls 29 of each container such that the two containers are urged into sealing contact with the panel 22. The rod 27 is preferably threaded on at least one end and one fastener is threaded onto the rod to adjustably secure the apparatus 20 in position with respect to the aperture 21. No other engaging or supporting means is necessary to secure the apparatus 20 in position on the panel 22.

Preferably, an anode 30 is mounted upon the rod 27 and positioned thereon such that the anode 30 is adjacent the aperture interior surfaces to be plated. Where the rod 27 is electrically conductive, the anode is connected to a power source (not shown) by means of an electrical cable 31 secured to the rod 27 by the fastener means 28.

Figure 3:
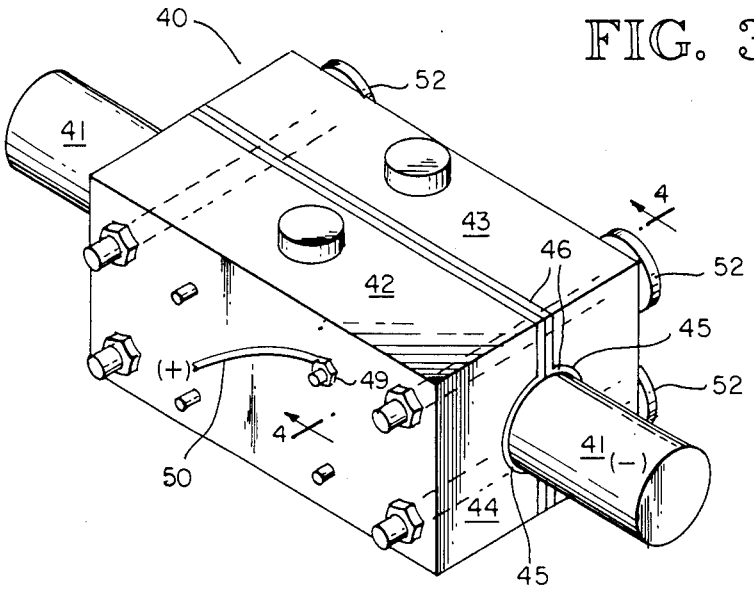
FIG. 3 is a schematic view of an apparatus of the invention for plating an elongated workpiece.
Figure 4:
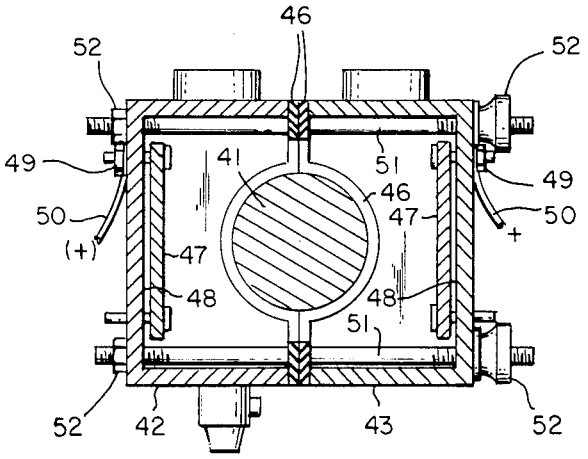
FIG. 4 is a sectional view of the apparatus of FIG. 3 suitable for plating an elongated workpiece.

Another embodiment 40 of the invention is shown in FIGS. 3 and 4 for plating a selective length of an elongated working piece 41. As shown in FIG. 3, the apparatus includes a pair of containers 42, 43, each including an open sidewall that engages the open sidewall of the other container to enclose a desired length of the workpiece. The end walls 44 of each container are provided with contours or cutouts 45 to accommodate the cross-section of the workpiece 41, to enclose the desired portion while the remainder of the workpiece projects from the joined containers. Appropriate seals 46 are provided to form a water-tight joint between the container pair and the projecting workpiece.

A pair of anodes 47 are fastened to, but insulated from, the interior container walls 48. An insulated fitting 49 is provided to electrically connect the anodes 42 by means of cable 50 to a power source (not shown). The apparatus is secured and sealed to the workpiece by means of a number of bolts 51 that pass through both containers, spaced from the workpiece, that include fasteners 52 for adjustably urging the container pair together to provide a complete container for submerging the section of the elongated workpiece desired to be plated in a plating solution.

From the foregoing, it will be appreciated that, although embodiments of the invention have been described herein for purposes of illustration, various modifications may be made without deviating from the spirit and scope of the invention. Accordingly, the invention is not limited except as by the appended claims.

We claim:

1. An apparatus for electroplating an aperture in a workpiece, comprising:

a pair of containers, each including an open wall contoured to engage said workpiece adjacent to the aperture, said pair of containers engaging opposite sides of said workpiece to surround and isolate said aperture, said container pair including a plating solution that submerges said aperture;

an anode that is positioned within the aperture to be plated;

a rod means that passes through each container and the aperture upon which said anode is mounted for positioning in said aperture, said rod including fastening means that engage each container and urge the container pair into secure sealing contact with said workpiece; and a means for electrically connecting said anode and the workpiece as a cathode to a power source whereupon application of current to said anode causes said aperture to be plated.

2. The apparatus of claim 2 wherein said rod is an electrical conductor and electrical connection to said anode is achieved exterior to said container.

3. The apparatus of claim 2 wherein said rod is threaded at each end and a pair of fasteners engage said rod, at least one fastener adjustable to urge said containers into sealing contact with said workpiece.

4. The apparatus of claim 1 wherein each container includes an opening and discharge port for receiving and draining plating solution from said containers.

5. An apparatus for electroplating a portion of an elongated workpiece, comprising:

a pair of containers that together enclose a length of said workpiece, said container pair holding plating solution to submerge said workpiece therein, each container including an open wall that engages and seals to the other container, said wall contoured to include an aperture that accommodates a portion of the cross-section of the workpiece such that the container pair urged together in sealing contact, surround and contain an elongated length of said workpiece for plating with the remainder of the elongated workpiece projecting therefrom;

fastening means that pass through the container pair, spaced from the workpiece, and urge the two containers together into sealing contact with each other and the workpiece; and an anode, connected to a power source, fixed to but electrically isolated from an interior wall of said containers such that application of an electrical current to the anode with the workpiece connected as a cathode causes the length of enclosed workpiece to be plated.

* * * * *